US008915240B2

(12) United States Patent
Benedetti et al.

(10) Patent No.: US 8,915,240 B2
(45) Date of Patent: Dec. 23, 2014

(54) HEATING DEVICE

(75) Inventors: Joseph A. Benedetti, Nashville, TN (US); Ryan E. Ennis, Puyallup, WA (US); Chad R. Zimmerman, Milton, WA (US)

(73) Assignee: Innovative Hearth Products LLC, Nashville, TN (US)

( * ) Notice: Subject to any disclaimer, the term of this patent is extended or adjusted under 35 U.S.C. 154(b) by 552 days.

(21) Appl. No.: 13/273,398

(22) Filed: Oct. 14, 2011

(65) Prior Publication Data

US 2012/0216788 A1 Aug. 30, 2012

Related U.S. Application Data

(60) Provisional application No. 61/446,396, filed on Feb. 24, 2011.

(51) Int. Cl.
*F24B 1/188* (2006.01)
*F24B 1/189* (2006.01)

(52) U.S. Cl.
CPC ..... *F24B 1/188* (2013.01); *F24B 1/189* (2013.01)
USPC ..... 126/523; 126/500; 165/167; 165/168; 165/169; 165/53

(58) Field of Classification Search
CPC ..... F24B 1/1888; F24B 1/1902; F24B 7/025; F24B 7/045; F24H 3/067; F28D 21/0008
USPC ..... 126/3, 4, 6, 39 A, 58, 225, 509, 523; 165/48.1, 53–57, 146, 166, 168, 169
See application file for complete search history.

(56) References Cited

U.S. PATENT DOCUMENTS

| | | | | |
|---|---|---|---|---|
| 2,852,017 | A * | 9/1958 | Hamberg et al. | 126/90 R |
| 3,385,356 | A * | 5/1968 | Dalin | 165/146 |
| 4,502,463 | A * | 3/1985 | Gregory | 126/512 |
| 5,092,313 | A * | 3/1992 | Blackburn et al. | 126/512 |
| 5,299,558 | A * | 4/1994 | Binzer | 126/512 |
| 5,655,514 | A * | 8/1997 | Kowald et al. | 126/531 |
| 7,238,105 | B2 * | 7/2007 | Reinders | 454/223 |
| 2006/0086058 | A1 * | 4/2006 | Reinders | 52/204.1 |
| 2006/0185835 | A1 * | 8/2006 | Matsuzaki et al. | 165/166 |
| 2008/0043431 | A1 * | 2/2008 | Marotta et al. | 361/689 |
| 2009/0145581 | A1 * | 6/2009 | Hoffman et al. | 165/80.3 |
| 2009/0151711 | A1 * | 6/2009 | Wells et al. | 126/523 |

* cited by examiner

*Primary Examiner* — Jorge Pereiro

(57) ABSTRACT

One aspect provides a heating device comprising a firebox having a hearth therein and first and second heat exchange chambers, and a heat exchanging plate having a first surface and a second opposing surface. The heat exchanging plate is suspended above the hearth, such that the first surface is located between the hearth and the second surface. The heat exchanging plate has lower protrusions extending from the first surface and into the first heat exchange chamber, and upper protrusions extending from the second surface and into the second heat exchange chamber. A method of manufacturing a heating device is also disclosed.

20 Claims, 8 Drawing Sheets

EFFICIENCY VIA FLUE LOSS CALCULATION

| TEST | TAR | CO2 | FLUE TEMPERATURE | ROOM TEMPERATURE | DELTA T | DEGREE C | EFFICIENCY PERCENT |
|---|---|---|---|---|---|---|---|
| | | | | | | | |
| HX1 | 23.86 | 1.32 | 289 | 77 | 212 | 100.0 | 49.3 |
| HX1 | 23.86 | 1.32 | 307 | 72 | 235 | 112.8 | 45.8 |
| HX1 | 23.86 | 1.35 | 321 | 88 | 233 | 111.7 | 46.8 |
| HX2 | 23.86 | 1.35 | 308 | 79 | 229 | 109.4 | 47.3 |
| HX3 | 23.86 | 1.35 | 307 | 73 | 234 | 112.2 | 46.6 |
| HX4 | 23.86 | 1.38 | 315 | 78 | 237 | 113.9 | 46.8 |
| STEEL | 23.86 | 1.25 | 320 | 77 | 243 | 117.2 | 42.9 |
| STEEL1 | 23.86 | 1.25 | 317 | 80 | 237 | 113.9 | 43.9 |
| STEEL2 | 23.86 | 1.28 | 326 | 82 | 244 | 117.8 | 43.5 |
| STEEL3 | 23.86 | 1.28 | 327 | 79 | 248 | 120.0 | 42.9 |

FIG. 7

HEATING DEVICE

CROSS-REFERENCE TO RELATED APPLICATION

This application claims the benefit of U.S. Provisional Application Ser. No. 61/446,396, filed by Joseph A. Benedetti on Feb. 24, 2011, entitled "INTEGRATED HEAT EXCHANGING WOOD STOVE FIRE BOX TOP," commonly assigned with this application and incorporated herein by reference.

TECHNICAL FIELD

This application is directed, in general, to a heating device and, more specifically, to a heat exchanging, wood stove fire box top.

BACKGROUND

Wood burning stoves have become commonplace in today's building trades for both residential and commercial applications, whether for providing heat or for value enhancement. Where a more massive fireplace is not desired or feasible, wood stoves are a highly desirable option. Stoves are often preferred over open fireplaces because many wood stoves have the capability to heat large spaces efficiently from a center-room location. Most of these stoves are able to burn for extended periods of time, such as over night, without refueling or reloading, further enhancing the preference over conventional masonry fireplaces. The fact that the stove fully contains the fire while providing heat in a full circle around the stove makes the wood stove highly desirable. In general, wood stoves are much less expensive than a comparable masonry fireplace. However, these stoves have seen little effort directed toward improving the efficiency of heat transfer into the room.

SUMMARY

One aspect provides a heating device comprising a firebox having a hearth therein and first and second heat exchange chambers, and a heat exchanging plate having a first surface and a second opposing surface. The heat exchanging plate is suspended above the hearth, such that the first surface is located between the hearth and the second surface. The heat exchanging plate has lower protrusions extending from the first surface and into the first heat exchange chamber, and upper protrusions extending from the second surface and into the second heat exchange chamber.

In a further aspect, a method of manufacturing a heating device is provided comprising forming a firebox having a hearth therein and first and second heat exchange chambers, and suspending a heat exchanging plate above the hearth. The heat exchanging plate has a first surface and a second opposing surface, such that the first surface is located between the hearth and the second surface. The heat exchanging plate has lower protrusions extending from the first surface and into the first heat exchange chamber and upper protrusions extending from the second surface and into the second heat exchange chamber.

BRIEF DESCRIPTION

Reference is now made to the following descriptions taken in conjunction with the accompanying drawings, in which:

FIG. 7 is a table of efficiency results for the heat exchanging plate versus a conventional flat plate.

DETAILED DESCRIPTION

The principles described in this discussion directed to a heating device, while described with reference to a wood burning stove, are equally applicable to other heating devices, e.g., fireplace inserts, etc.

Figure 1A:
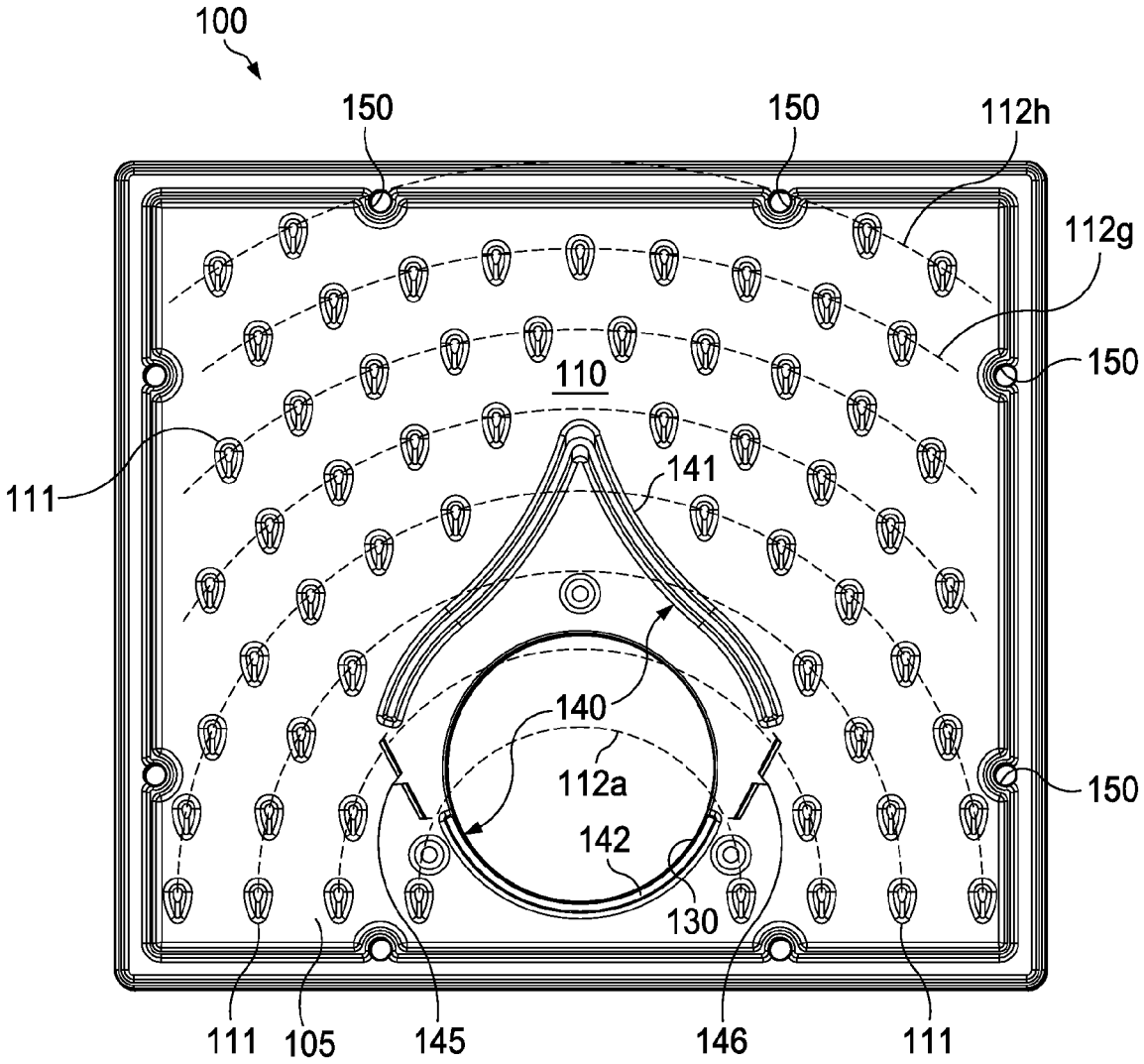
FIG. 1A is a plan view of a first surface of one embodiment of a wood burning stove heat exchanging plate.
Figure 1B:
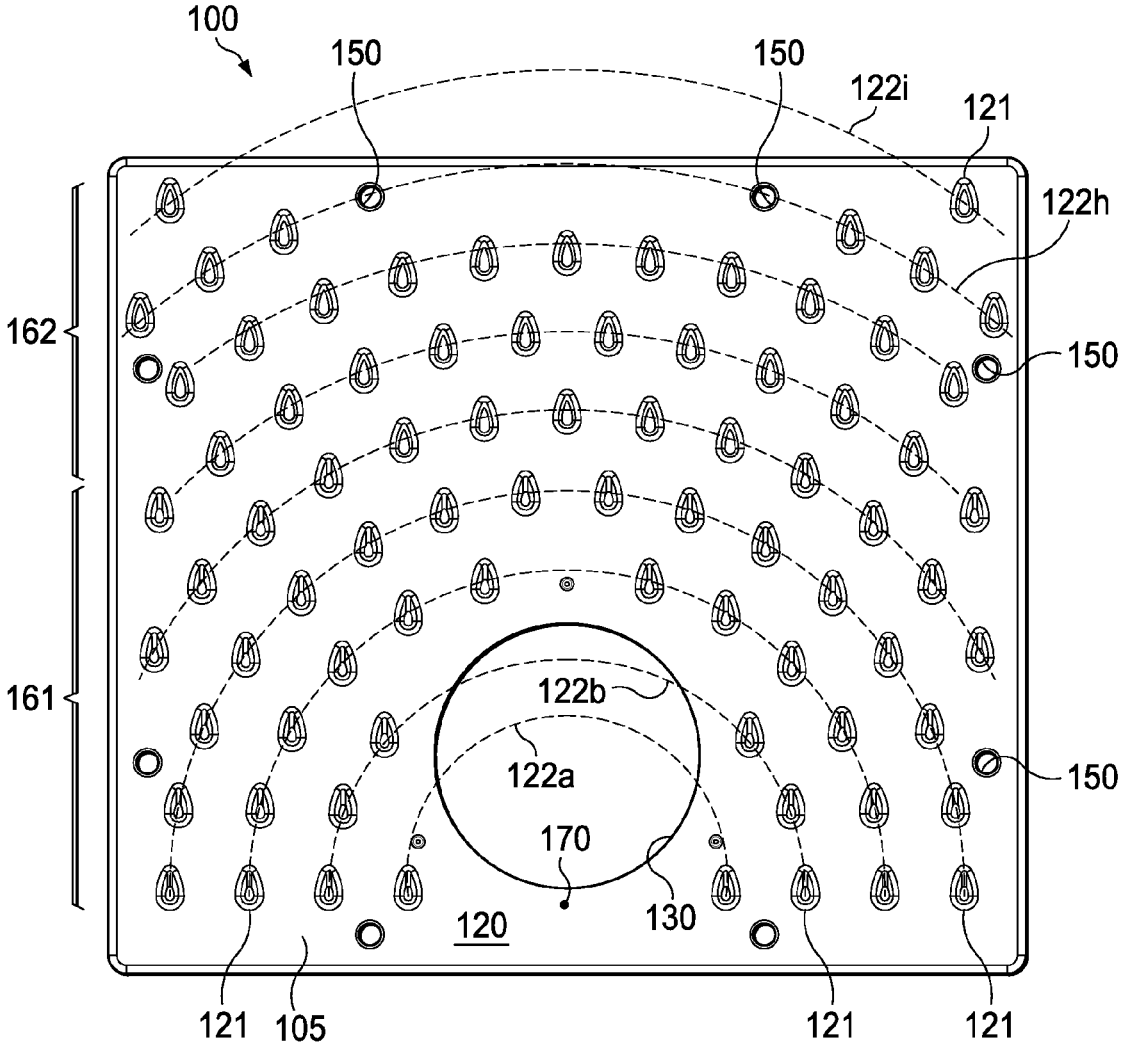
FIG. 1B is a plan view of a second opposing surface of one embodiment of a wood burning stove heat exchanging plate.

Referring initially to FIGS. 1A and 1B, illustrated are plan views of a first surface and a second opposing surface, respectively, of one embodiment of a wood stove heat exchanging plate 100. The heat exchanging plate 100 comprises a plate body 105 having a first surface 110, a second opposing surface 120, a flue aperture 130, a flow diverter 140, coupling apertures 150, and first and second regions 161, 162, respectively. The first surface 110 may have a plurality of lower protrusions 111 extending therefrom while the second surface 120 may have a similar plurality of upper protrusions 121 extending therefrom. In one embodiment, each of the upper protrusions 121 may overlie a corresponding, polar opposite, lower protrusion 111; however, in other embodiments, the upper and lower protrusions 121, 111 may be off-set from one another.

In one embodiment, the plurality of upper protrusions 121 and corresponding polar opposite lower protrusions 111 may be arrayed in upper arcs 122*a*-122*i* and lower arcs 112*a*-112*h*, respectively, around the flue aperture 130. However, it should be noted that other embodiments provide that the protrusions may be arranged in straight line or off-set formations. The upper and lower arcs 122*a*-122*i* and 112*a*-112*h*, respectively, are not necessarily concentric to the flue aperture 130. In one embodiment, the upper and lower arcs 122*a*-122*i* and 112*a*-112*h* are concentric to a point 170. Positioning of the flow diverter 140 may require that certain of the lower protrusions 111 be foregone, i.e., construction or forming of the flow diverter 140 prevents forming of certain of the lower protrusions 111. The flow diverter 140, in one aspect, may comprise a first wishbone-shaped forward diverter 141 and a second arcuate rear diverter 142. The first wishbone-shaped forward diverter 141 and second arcuate rear diverter 142 may be separated by first and second gaps 145, 146, respectively.

In one embodiment, the heat exchanging plate 100 including the plurality of lower and upper protrusions 111, 121, respectively, the flue aperture 130, and the flow diverter 140, may be simultaneously formed of cast iron by traditional methods. The height and geometric configurations of the protrusions 111, 121, may vary. For example, in one embodiment, the heights of the protrusions may gradually increase from one region of the heat exchanging plate 100 to another region of the heat exchanging plate 100. In another example, the upper protrusions 121 within the first region 161 may be substantially equal in height above the second surface 120 as the lower protrusions 111 are in height below the first surface 110. In one aspect of this embodiment, the lower protrusions may be 1.3 inches in height while the upper protrusions 121 within the first region 161 may be 1.5 inches in height. Conversely, the upper protrusions 121 within the second region 162 may be substantially shorter in height above the second surface 120 than the lower protrusions 111 are in height below the first surface 110. For example, in one embodiment, the upper protrusions within the second region 162 may be 0.375 inches in height.

Figure 2A:
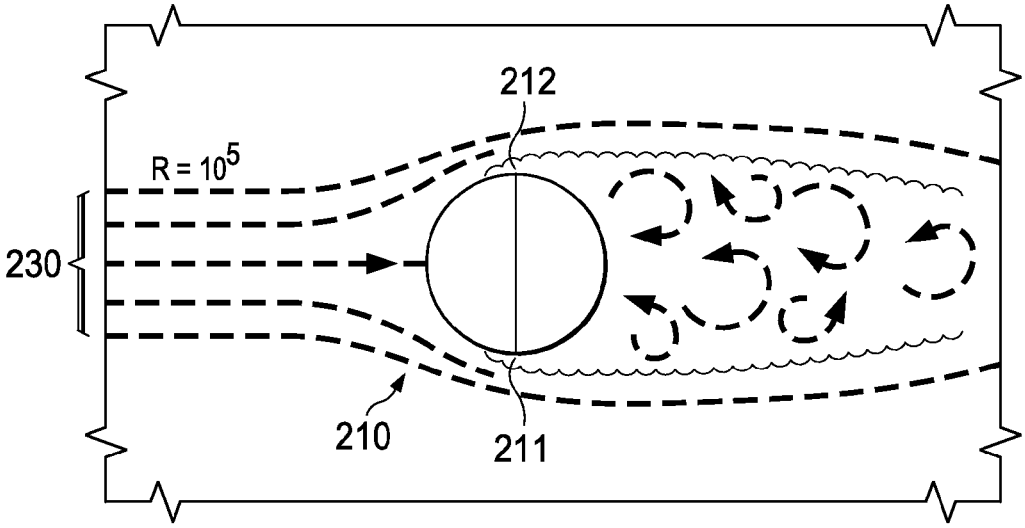
FIG. 2A is a sectional view of a round airfoil in a free-stream, laminar airflow.

Cross sections of airfoils referenced in this description are taken parallel to the surface 110 or 120 of the heat exchanging plate 100. FIG. 2A illustrates a cross section of one geometric configuration that the protrusion might take. In this embodiment, the geometric configuration is a round airfoil 210 in a free-stream, laminar airflow 230. A free-stream, laminar airflow 230 is generally representative of the flow of combustion products and room air over the surfaces 110, 120 of the heat exchanging plate 100 in heat exchanging chambers to be described below. Note that the airflow around the round airfoil 210, as might be achieved by affixing round rods sticking up from the surfaces of a heat exchanging plate, separates from free-stream laminar flow and becomes turbulent just prior to points 211, 212 on the surface of the rod/round airfoil 210. Points 211, 212 are found by constructing a diameter d that is normal to the airflow through the center of the rod/round airfoil 210. Of course, the actual points 211, 212 will vary as no flow is perfectly laminar. One who is of skill in the art will recognize that low speed airflow 230 around the cylinder 210 will be laminar flow around the leading edge of the cylinder 210 and turbulent flow from points 211, 212 on the surface of the cylinder 210 and beyond.

Figure 2B:
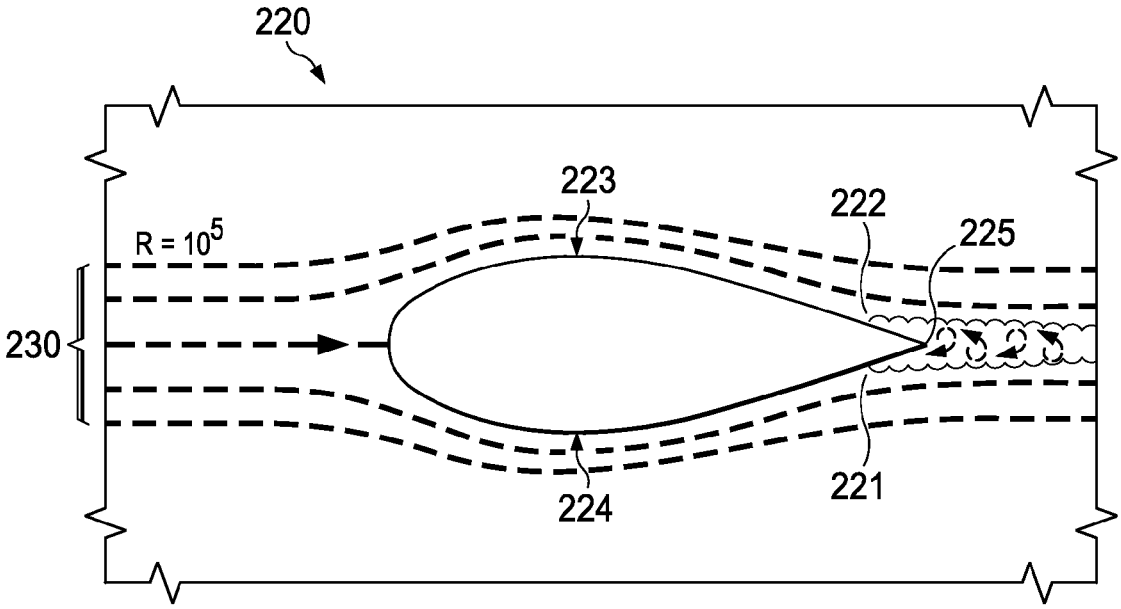
FIG. 2B is a sectional view of a symmetric low-speed airfoil in the same free-stream, laminar airflow as in FIG. 2A.

Referring now to FIG. 2B illustrated is a sectional view of another geometric configuration that the protrusions 111, 121 might take. In this particular embodiment, the configuration is a symmetric low-speed airfoil 220 in the same free-stream, laminar airflow as in FIG. 2A. In this case, the symmetric low-speed airfoil 220 has a maximum thickness d equal to the diameter d of the rod 210 of FIG. 2A. The symmetric low-speed airfoil 220 is representative of one of the lower and upper protrusions 111, 121, respectively. In one embodiment, the lower and upper protrusions 111, 121 may comprise an airfoil cross section tapering in thickness d toward the tip much as a low-speed wing cross section has a decreasing thickness toward the wing tip. In a preferred embodiment, the lower and upper protrusions 111, 121 may comprise an airfoil cross section that is symmetric about the chord line of the airfoil. The chord line being defined as a straight line drawn from the leading edge of the airfoil to the trailing edge. In contrast to the rod/round airfoil 210 of FIG. 2A, airflow around the symmetric low-speed airfoil 220 remains laminar along the first and second surfaces 223, 224 of the low-speed airfoil 220 until at points 221, 222 almost at the trailing edge 225 of the low-speed airfoil 220. Because of the laminar flow around most of the low-speed airfoil 220, air flow remains in contact with the surfaces 223, 224 of the low-speed airfoil 220 for a greater time than with the rod/round airfoil 210; thus ensuring significant heat transfer between the airflow 230 and the low-speed airfoil 220. The same principle will be used in the transfer of heat from the second side of the heat exchanging plate with upper protrusions to the room air as will be described below.

Figure 3:
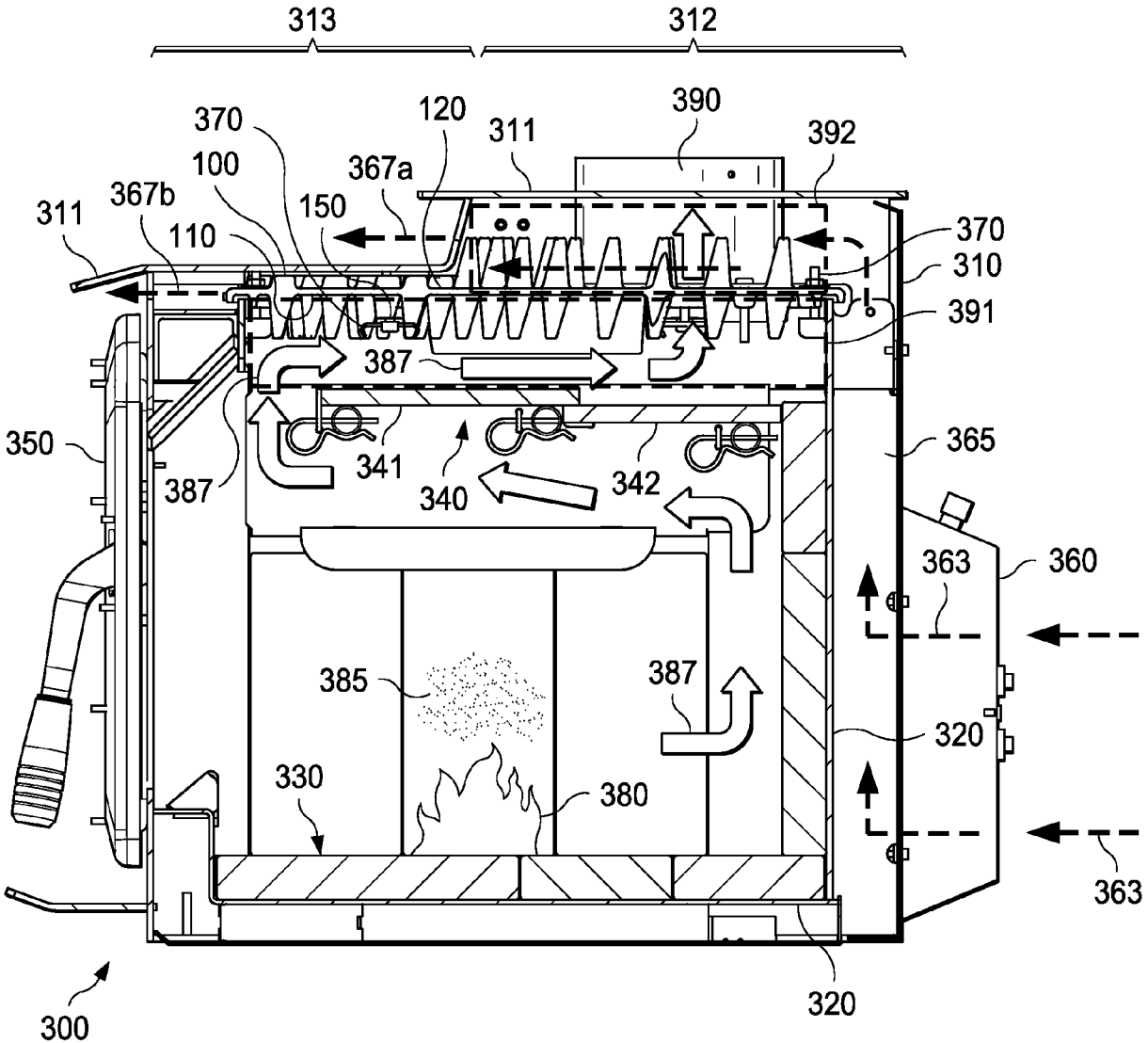
FIG. 3 is a right side, vertical sectional view of one embodiment of a stove employing the heat exchanging plate of FIG. 1.

Referring now to FIG. 3, with continuing reference to FIGS. 1A and 1B, illustrated is a right side, vertical sectional view of one embodiment of a wood burning stove 300 employing the heat exchanging plate 100 of FIG. 1. The stove 300 comprises a stove cabinet 310, a firebox 320, a hearth 330, a flue baffle plate assembly 340, a firebox door 350, a fan 360, a flue 390 and first and second heat exchange chambers 391, 392, respectively.

The heat exchanging plate 100 may be coupled to the stove cabinet 310 and the firebox 320 with mechanical fasteners 370 through coupling apertures 150. In one embodiment, the flue baffle plate assembly 340 may be a ceramic plate; however, other heat retaining materials, such as metal and alloys thereof may be used. In a preferred embodiment, the flue baffle plate assembly 340 may comprise first and second ceramic plates 341, 342, respectively. The first heat exchange chamber 391 is bounded from below by the flue baffle plate assembly 340 and from above by the first surface 110 of the heat exchanging plate 100. The second heat exchange chamber 392 is bounded from below by the second surface 120 of the heat exchanging plate 100 and from above by a stove cabinet top 311. The first heat exchange chamber 391 is bounded also by the side walls (not shown) of the firebox 320. The second heat exchange chamber 392 is, in a like manner, bounded by the side walls (not shown) of the cabinet 310. In a preferred embodiment, the stove cabinet top 311 has a first section 312 and a second section 313 at different heights above the heat exchanging plate 100 to accommodate the different heights of upper protrusions 121 in the first and second heat exchanging plate regions 161, 162, respectively.

In general operation, the stove 300 houses a fire 380 on the hearth 330. The fire 380 generates heated combustion products 385 that circulate via pathway 387 through the first heat exchange chamber 391 and out the flue 390. Ambient air is drawn in through the fan 360, forced through a duct 365 into the second heat exchange chamber 392, across protrusions 121 and out the front of the stove cabinet 310 as two conditioned airflows 367*a*, 367*b*, collectively 367.

Figure 4:
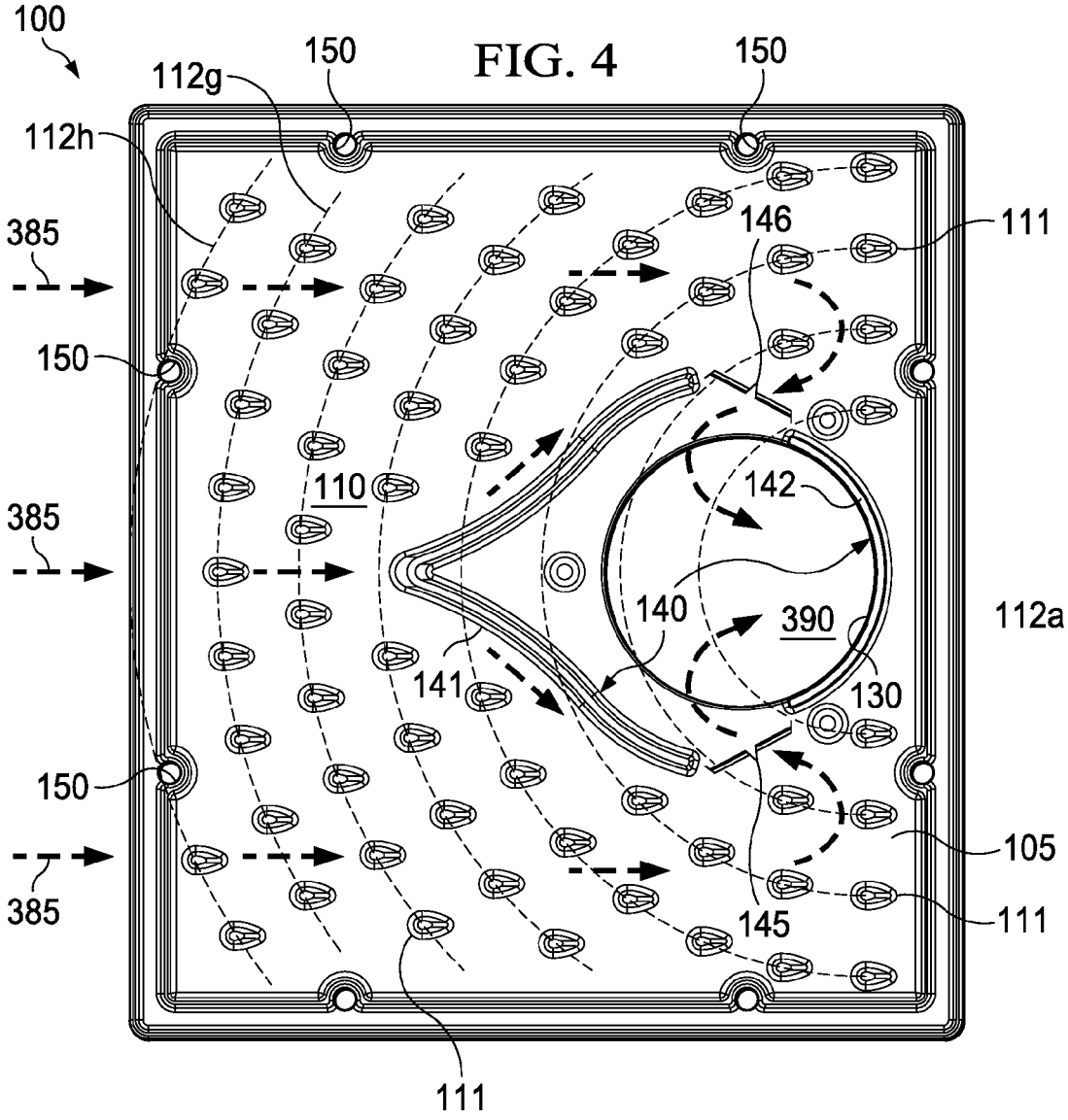
FIG. 4 is a plan view of the first surface of one embodiment of the wood burning stove heat exchanging plate with combustion products flow depicted.

Referring now to FIG. 4 with continuing reference to FIG. 3, illustrated is a plan view of the first surface 110 of one embodiment of the wood burning stove heat exchanging plate 100 with combustion products 385 flow depicted. Shown thereon is the path of the combustion products 385 across the first surface 110 and around the plurality of lower protrusions 111. Note that the leading edges (blunt end) of the lower protrusions 111 are positioned into the prevailing combustion products flow 385. The combustion products 385 are deflected by and around the first wishbone-shaped forward diverter 141. The forward diverter 141 combined with the second arcuate rear diverter 142 causes the combustion products 385 to flow toward a back of the first heat exchange chamber 391 and then through the first and second gaps 145, 146 and up the flue 390. As the combustion products 385 flow through the first heat exchange chamber 391, heat is transferred from the combustion products 385 to the first surface 110, the plate body 105 and the plurality of lower protrusions 111. The forward diverter 141 generally assures that the combustion products 385 do not immediately exit the first heat exchange chamber 391 through the flue 390 without at least transferring some heat to the back part of the heat exchanging plate 100. Heat is then further transferred by conduction to the second opposing surface 120 and to the plurality of upper protrusions 121.

Figure 5:
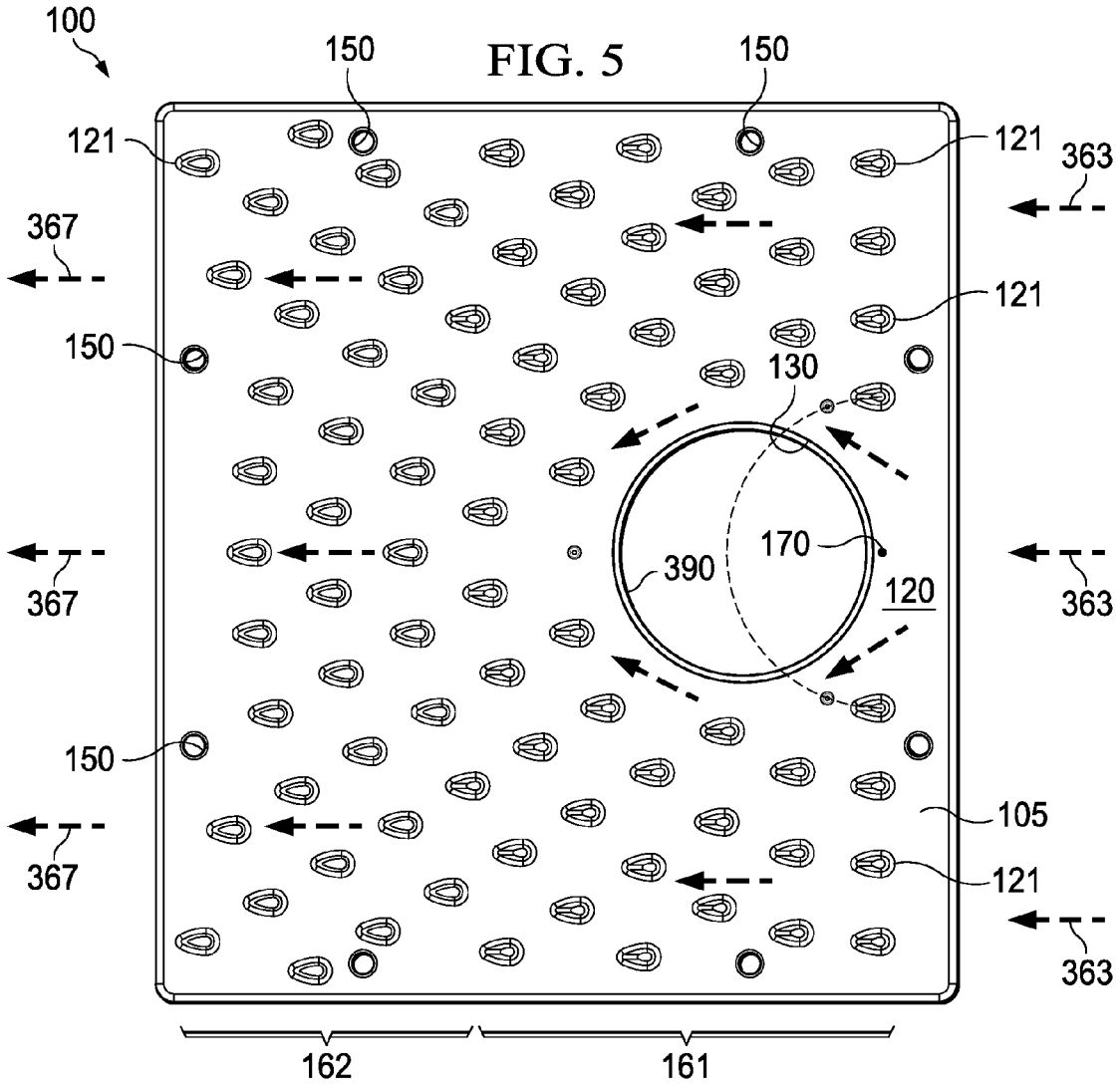
FIG. 5 is a plan view of the second opposing surface of the heat exchanging plate 100 with heating air flow depicted.

Referring now to FIG. 5 with continuing reference to FIG. 3, illustrated is a plan view of the second opposing surface 120 of the heat exchanging plate 100 with heating air flow depicted. Shown thereon is the path of the ambient room air 363 drawn in through fan 360 and directed through duct 365 to the second heat exchange chamber 392, across the second opposing surface 120, around the flue 390 and the plurality of upper protrusions 121. Air flowing across the second opposing surface 120 and ejected into the room is designated conditioned air 367 and shown in FIG. 3 as conditioned air 367*a*, 367*b*.

Figure 6A:
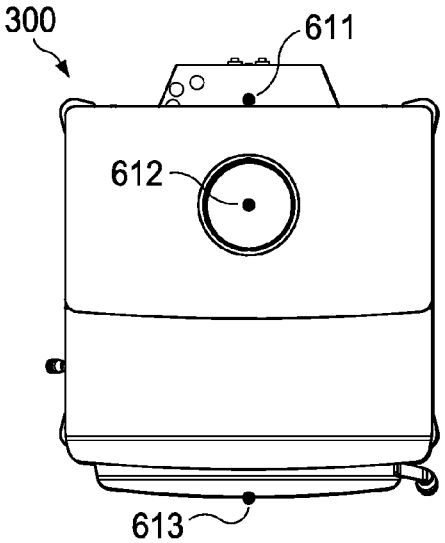
FIG. 6A is a top view of the stove of FIG. 3.
Figure 6B:
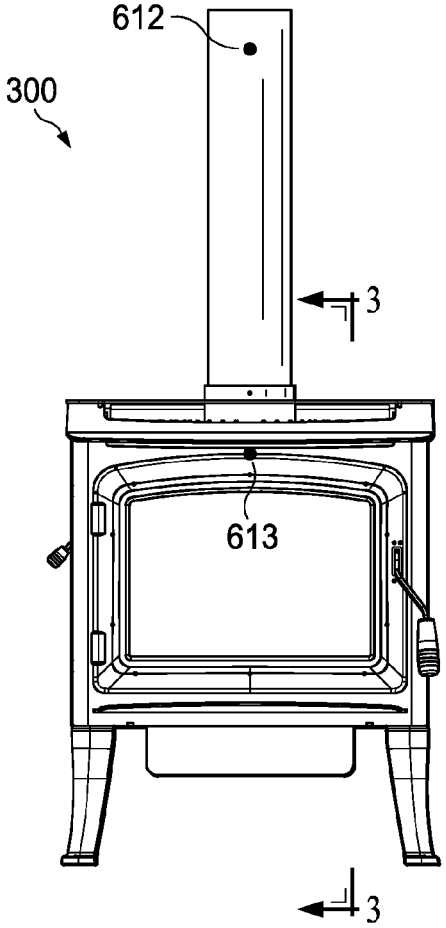
FIG. 6B is a front elevation view of the stove of FIG. 3.
Figure 6C:
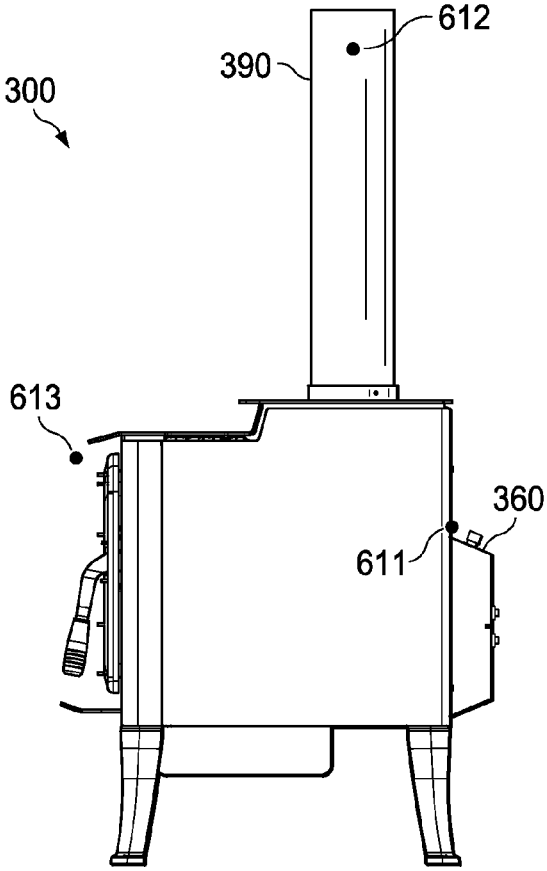
FIG. 6C is a right side elevation view of the stove of FIG. 3.

Referring now to FIGS. 6A-6C, illustrated are a top, front and right side elevation views, respectively, of the stove 300 of FIG. 3. The stove 300 illustrates three points in the vicinity of the stove where temperature data was collected to compare a conventional steel firebox top to the heat exchanging plate 100 of the present discussion. The first temperature collection point 611 is that of ambient air being drawn into the fan 360 of the stove 300. The second temperature collection point 612 is within the flue 390. The third temperature collection point 613 corresponds to the heated air 367 being expelled from the top front of the stove 300.

For comparative testing, a conventional steel firebox top was provided of 0.25" thick, hot rolled steel. The steel firebox top was intended as the baseline of conventional design to be compared to the heat exchanging design of the present disclosure. A cast iron prototype of the heat exchanging plate 100 was formed to provide comparative data on the new design.

Three test runs of the conventional steel firebox top without protrusions were accomplished and the temperature results are shown as follows:

| Sample Sets | Ambient Air ° F. | Flue Temp ° F. | Heated Air ° F. | ΔT = Heated − Ambient |
|---|---|---|---|---|
| Steel 1 | 80 | 317 | 111 | 31 |
| Steel 2 | 82 | 326 | 115 | 33 |
| Steel 3 | 79 | 327 | 109 | 30 |

Four test runs of the cast iron heat exchanging plate 100 were made with the temperature results as shown:

| Sample Sets | Ambient Air ° F. | Flue Temp. ° F. | Heated Air ° F. | ΔT = Heated − Ambient |
|---|---|---|---|---|
| Heat Exchange 1 | 88 | 321 | 135 | 47 |
| Heat Exchange 2 | 79 | 308 | 130 | 51 |
| Heat Exchange 3 | 73 | 307 | 120 | 47 |
| Heat Exchange 4 | 78 | 315 | 123 | 45 |

These temperatures can be converted to approximate BTUs into the conditioned space with the formula: BTU/hr=CFM*ΔT*1.08. For the cast iron heat exchanging plate of the present discussion, the average temperature increase in the heated air over the ambient air is: ΔT=47.5° F. For the conventional steel firebox top, the average temperature increase in the heated air over the ambient air is: ΔT=31° F. The heat output results are:

| | CFM | ΔT | BTU/hr |
|---|---|---|---|
| Heat Exchange | 50 | 47.5 | 2565 |
| Conv. Steel | 50 | 31.3 | 1690 |

Heat output may be compared to that of the conventional stove top by dividing the heat (BTU/hr) increase of 875 BTU/hr by the conventional steel firebox top output of 1690 BTU/hr. The result is a heat output increase of 52.3%. Thus, the cast iron heat exchanger significantly improved heated air output by more than a 50% increase over a conventional steel firebox top design.

Stove efficiency can be expressed as:

$$\text{Efficiency}=(100-\text{T.A.R.})-[(0.343/CO2m+0.009)*\Delta T]$$

where T.A.R. is Theoretical Air Requirement which for propane gas, the fuel used, equals 23.86. CO2m is measured CO2, ΔT is the flue loss temperature, i.e., flue temperature minus room temperature in ° C. and the ° F. to ° C. conversion is:

$$°\,C.=5/9*(°\,F.-32).$$

Thus efficiency results for the cast iron heat exchanging plate vs. steel firebox top are shown in FIG. 7.

The average efficiency of the heat exchanging plate is 47.1% vs. the average efficiency of the steel firebox top being 43.3%. Thus, the efficiency improvement is (47.1%−43.3%)/43.3%=8.8% improvement.

Thus, a wood stove, as an example of a heating device, comprising a heat exchanging plate defining the boundary between the combustion products and conditioned/circulating room air has been described. The heat exchanging plate comprises aerodynamic protrusions on lower and upper surfaces thereof to better transfer heat from the combustion products to the heat exchanging plate in the first heat exchange chamber, thence through the heat exchanging plate and to the circulating room air in the second heat exchange chamber.

For the purposes of this discussion, use of the terms "providing" and "forming," etc., includes: manufacture, subcontracting, purchase, etc. Those skilled in the art to which this application relates will appreciate that other and further additions, deletions, substitutions and modifications may be made to the described embodiments.

What is claimed is:

1. A heating device, comprising:

a firebox having a hearth therein and first and second heat exchange chambers;

a heat exchanging plate located over said hearth and having a first surface and a second opposing surface such that said first surface is located between said hearth and said second surface, said heat exchanging plate having lower protrusions extending from said first surface and into said first heat exchange chamber, upper protrusions extending from said second surface and into said second heat exchange chamber;

a flue aperture extending through said heat exchanging plate; and a flow diverter coupled to said first surface and surrounding at least a portion of said flue aperture.

2. The heating device as recited in claim 1 further comprising a flue baffle plate located below said heat exchanging plate such that said heat exchanging plate and said flue baffle plate comprise upper and lower boundaries, respectively, of said first heat exchange chamber.

3. The heating device as recited in claim 1 wherein said heating device further comprises a flue coupled to said flue aperture.

4. The heating device as recited in claim 1 further comprising a heating device cabinet top coupled to said heat exchanging plate such that said heat exchanging plate and said heating device cabinet top comprise lower and upper boundaries, respectively, of said second heat exchange chamber.

5. The heating device as recited in claim 4 further comprising a fan fluidly coupled to said second heat exchange chamber.

6. The heating device as recited in claim 1 wherein said upper and lower protrusions have airfoil cross sections and wherein a first plurality of said upper protrusions overlies a corresponding second plurality of said lower protrusions.

7. The heating device as recited in claim 6 wherein said airfoil cross sections are symmetric airfoil sections.

8. The heating device as recited in claim 1 wherein at least some of said upper and lower protrusions are spaced apart on a plurality of arcs.

9. A heating device, comprising:

a firebox having a hearth therein and first and second heat exchange chambers; and a heat exchanging plate located over said hearth and having a first surface and a second opposing surface such that said first surface is located between said hearth and said second surface, said heat exchanging plate having lower protrusions extending from said first surface and into said first heat exchange chamber and upper protrusions extending from said second surface and into said second heat exchange chamber, wherein said second surface has first and second regions, said first region having upper protrusions substantially equal in height to said lower protrusions and said second region having upper protrusions substantially shorter in height than said lower protrusions.

10. The heating device as recited in claim 9 further comprising a flue baffle plate located below said heat exchanging plate such that said heat exchanging plate and said flue baffle plate comprise upper and lower boundaries, respectively, of said first heat exchange chamber.

11. The heating device as recited in claim 9 wherein said upper and lower protrusions have airfoil cross sections and wherein a first plurality of said upper protrusions overlies a corresponding second plurality of said lower protrusions.

12. A method of manufacturing a heating device, comprising:

forming a firebox having a hearth therein and first and second heat exchange chambers;

suspending a heat exchanging plate above said hearth, said heat exchanging plate having a first surface and a second opposing surface, such that said first surface is located between said hearth and said second surface, said heat exchanging plate having lower protrusions extending from said first surface and into said first heat exchange chamber and upper protrusions extending from said second surface and into said second heat exchange chamber;

forming a flue aperture through said heat exchanging plate; and coupling a flow diverter to said first surface and surrounding at least a portion of said flue aperture.

13. The method as recited in claim 12 further comprising suspending a flue baffle plate below said heat exchanging plate such that said heat exchanging plate and said flue baffle plate comprise upper and lower boundaries, respectively, of said first heat exchange chamber.

14. The method as recited in claim 12 wherein said method further comprises coupling a flue to said flue aperture.

15. The method as recited in claim 12 further comprising coupling a heating device cabinet top to said heat exchanging plate such that said heat exchanging plate and said heating device cabinet top comprise lower and upper boundaries, respectively, of said second heat exchange chamber.

16. The method as recited in claim 15 further comprising fluidly coupling a fan to said second heat exchange chamber.

17. The method as recited in claim 12 wherein suspending includes providing said heat exchanging plate wherein said upper and lower protrusions have airfoil cross sections and wherein a first plurality of said upper protrusions overlies a corresponding second plurality of said lower protrusions.

18. The method as recited in claim 17 wherein providing includes said airfoil cross sections having symmetric airfoil sections.

19. The method as recited in claim 12 wherein suspending includes providing said heat exchanging plate wherein said second surface has first and second regions, wherein said first region has upper protrusions substantially equal in height to said lower protrusions and wherein said second region has upper protrusions substantially shorter in height than said lower protrusions.

20. The method as recited in claim 12 wherein suspending includes providing said heat exchanging plate wherein at least some of said upper and lower protrusions are spaced apart on a plurality of arcs.

* * * * *